US005490588A

United States Patent [19]

Nishiumi et al.

[11] Patent Number: 5,490,588

[45] Date of Patent: Feb. 13, 1996

[54] COIN PROCESSING APPARATUS

[75] Inventors: Kenji Nishiumi, Hanno; Toshio Osawa, Fujimi; Kanesue Shimizu; Shinichi Machida, both of Sakado, all of Japan

[73] Assignee: Nippon Conlux Co., Ltd., Tokyo, Japan

[21] Appl. No.: 170,552

[22] Filed: Dec. 20, 1993

[30] Foreign Application Priority Data

Dec. 21, 1992 [JP] Japan ..... 4-340646
Jan. 18, 1993 [JP] Japan ..... 5-005709

[51] Int. Cl.[6] ..... G07D 5/08; G07F 1/04

[52] U.S. Cl. ..... 194/317; 194/346

[58] Field of Search ..... 194/240, 241, 194/317, 318, 344, 346

[56] References Cited

U.S. PATENT DOCUMENTS 3,916,922 11/1975 Prumm ..... 194/346 X
4,582,189 4/1986 Schmitt ..... 194/346 X
4,625,851 12/1986 Johnson et al. ..... 194/346 X
4,884,672 12/1989 Parker ..... 194/346 X
5,167,314 12/1992 Levasseur ..... 194/346

FOREIGN PATENT DOCUMENTS 2112195 7/1983 United Kingdom ..... 194/346

*Primary Examiner*—Michael S. Huppert
*Assistant Examiner*—Scott L. Lowe
*Attorney, Agent, or Firm*—Loeb and Loeb

[57] ABSTRACT

Coin processing apparatus electromagnetically tests an inserted coin, separates genuine coins from counterfeit coins by a first pathway switching mechanism, and stores genuine coins in change tubes and a cash-box by a second pathway switching mechanism, according to the type of coin. The pathway along which the coins pass is provided with pass sensors at two positions therein, where one pass sensor detects the coins and the other pass sensor controls the operation of the second pathway switching mechanism in such as manner as to prevent passing coins from becoming trapped therein. The second pathway switching mechanism is operated after a predetermined time has elapsed from the fall of a detection signal from a pass sensor, to end the flow of current through and thereby prevent overheating of a solenoid therein.

5 Claims, 8 Drawing Sheets

COIN PROCESSING APPARATUS

SCOPE OF THE INVENTION

The present invention relates to a coin processing apparatus for a vending machine and, in particular, to a coin processing apparatus wherein it is made difficult for a coin inserted into the coin processing apparatus to become jammed partway along a coin pathway.

PRIOR ART

A coin processing apparatus of the prior art is configured as shown in FIG. 6A and FIG. 6B. In this apparatus, a coin X inserted through a coin insertion slot 1 falls downward along a first rail 2 that is provided at a slant. The coin X rotates along the first rail 2 and passes through a coin testing portion 3.

The coin testing portion 3 applies an electromagnetic field to the coin in order to test the quality and dimensions thereof, and outputs the test results to a decision apparatus that is not shown in the figures. The decision apparatus determines whether the coin is counterfeit or genuine in answer to the test result signal from the coin testing portion 3, and generates a signal used for coin processing or product sales.

One aspect of the coin processing is such that, if the control portion of the apparatus should state that there is no change available at that point, the coin is returned when a coin acceptance inhibition signal is output, regardless of whether the coin is counterfeit or genuine, whereupon a first solenoid 5 is left deactivated and thus a first gate 4 is placed in the position shown in the figures to guide the inserted coin X into a return pathway. Another aspect of the coin processing is such that an accumulation status of change in a change tube 11 determines whether the inserted coin X is either guided along a change tube pathway 14 or is guided into a cash-box pathway 9, and the operation of a second solenoid 8 is controlled in such a manner that the second solenoid 8 is either activated or left deactivated to determine the pathway the coin X passes along, in accordance with the test result of the coin testing portion 3.

For product sales, the decision portion calculates the amount of money from the coin type which is the test result of the coin testing portion 3 and the number of coins as determined by a pass sensor 6, subtracts the price of the product, to determine if change is required, then generates and outputs signals for product sales and change output.

The above comprises the coin processing of the coin processing apparatus.

Typical examples of this prior art are disclosed in, for instance, U.S. Pat. No. 4,106,610 and Japanese Patent Publication No. 43798/1984.

The coin pathway is configured of a combination of two slanting pathways aligned in mutually opposite directions, as shown in FIG. 6A and FIG. 6B. When the coin leaves the pass sensor 6 after the first gate 4 and goes toward the change tube pathway, the direction of a second gate 7 is reversed. Therefore, the time from when each coin X leaves the first gate 4 until it aims for the change tube pathway 14 can vary, regardless of any differences in the coins.

The second gate 7 is designed to be opened and shut by the activation and deactivation of the second solenoid 8, and a signal for the second solenoid 8 is arranged such that the second solenoid 8 is not deactivated until a predetermined time has elapsed after the coin X has passed the pass sensor 6, as shown in the timing chart of FIG. 7.

Therefore, if the coin X is slow in reaching the second gate 7, the coin X could be trapped by the closing second gate 7. This status in which the coin X is jammed in the second gate 7 is shown in FIG. 8. If another coin X is inserted at this point, the coin X will jam in the coin pathway and it will no longer be possible to process the coins smoothly.

PROBLEM TO BE SOLVED BY THE PRESENT INVENTION

The various signals generated by the circuits that operate the apparatus of FIG. 6A and FIG. 6B, including the second solenoid signal, are shown in the timing chart of FIG. 7, which illustrates the deactivation after a predetermined time (set beforehand in a delay timer) has elapsed after the coin X has passed the pass sensor 6.

In this case, the second solenoid signal rises along with the rise of a genuine-coin signal and falls when the predetermined time has elapsed after the coin X has passed the pass sensor 6. However, the time until this signal falls is undetermined because it is affected by how the coin X behaves in its passage.

Therefore, the second solenoid 8 may overheat because current is passing through it for too long a time.

The present invention has been devised after consideration of the above problems, and has as a first objective the provision of a coin processing apparatus devised such that coin jamming does not occur in the coin pathway.

A second objective of the present invention is to provide a coin processing apparatus devised such that it determines the point of time at which a current starts to flow, so that the time during which current passes through a second solenoid (which is provided for the second gate that sends a coin that is determined to be genuine into either a cash-box or a change tube pathway) is not extended for too long.

MEANS OF SOLVING THE PROBLEM

In order to achieve the first of the above objectives, the present invention relates to a coin processing apparatus wherein the quality and dimensions of a coin that is inserted through an insertion slot are electromagnetically tested by a testing portion as the inserted coin passes along a predetermined pathway, the inserted coin is sent along either a genuine-coin pathway or a counterfeit-coin pathway by the operation of a first pathway switching mechanism in accordance with the results of the testing and an acceptance enabling/disabling decision, then the coin is sent along either a cash-box pathway or a change tube pathway by the operation of a second pathway switching mechanism in accordance with a coin type obtained from the testing, where the change tube pathway is divided into separate tube pathways for each coin type. This coin processing apparatus is characterized in being provided with a first pass sensor which is provided in the genuine-coin pathway between the first pathway switching mechanism and the second pathway switching mechanism, and which detects the passing of the inserted coin, and a second pass sensor which is provided in the second pathway switching mechanism in the vicinity of an outlet slot on the side of the change tube pathway, and which detects the passage of the coin through the change tube pathway. In the coin processing apparatus configured as described above, the operation by the second pathway switching mechanism of sending the inserted coin into the change tube pathway is halted when the coin has passed the second pass sensor.

In order to achieve the second of the above objectives, the present invention provides a coin processing apparatus wherein the quality and dimensions of a coin that is inserted through an insertion slot are electromagnetically tested by a testing portion as the inserted coin passes along a predetermined pathway, the inserted coin is sent along either a genuine-coin pathway or a counterfeit-coin pathway by the operation of a solenoid of a first pathway switching mechanism in accordance with the results of the testing and an acceptance enabling/disabling decision, the passing of a genuine coin is detected as the coin passes by a pass sensor provided in the pathway, then the coin is sent along either a cash-box pathway or a change tube pathway by the operation of a solenoid of a second pathway switching mechanism in accordance with a coin type obtained from the results of the testing, where the change tube pathway is divided into separate tube pathways for each coin type. This coin processing apparatus is characterized in being provided with a solenoid activation circuit which starts the activation of the solenoid of the second pathway switching mechanism at the rise of a detection signal from the pass sensor and ends the activation after a predetermined time has elapsed after the fall of the detection signal from the pass sensor.

MEANS OF ACHIEVING THE FIRST OBJECTIVE

When the coin has passed the second pass sensor and a coin detection signal has been generated from the second pass sensor, the operation of the second pathway switching mechanism is halted at the final edge of the detection signal. Therefore, the halting of the operation of the second pathway switching mechanism comes after the coin has completely exited from the second pathway switching mechanism, and thus the coin does not become trapped in the second pathway switching mechanism.

As described above, since the operation of the second pathway switching mechanism is halted after the coin has completely exited from the second gate, the timing at which the second pathway switching mechanism closes is too quick in comparison with the movement of the coin within the pathway, so that the coin does not become trapped in the second pathway switching mechanism. Therefore, the incidence of coin jamming in this coin processing apparatus can be reduced.

MEANS OF ACHIEVING THE SECOND OBJECTIVE

The pass sensor is provided between the first pathway switching mechanism and the second pathway switching mechanism, it detects the passing of a coin, and outputs a signal. In answer to this output, the solenoid activation circuit activates the second solenoid and the second pathway switching mechanism is operated, so that the genuine coin is sent into the change tube pathway.

When enough time has expired to allow the genuine coin to be guided into the change tube, the solenoid activation circuit stops the activation of the second solenoid and the second pathway switching mechanism is returned to its original status.

When the inserted coin has passed the first pathway switching mechanism but has not yet passed the pass sensor, the second solenoid is not activated, so that current is not passed through the second solenoid for a long period of time.

As described above, since the activation of the second solenoid starts only after an inserted coin that is determined to be genuine has reached the pass sensor, the fault that can easily occur in a prior art apparatus such that the second solenoid is kept activated for an extremely long time because the inserted coin has not arrived at the pass sensor does not occur, and the second solenoid is prevented from overheating and burning out.

DETAILED DESCRIPTION OF THE PREFERRED EMBODIMENT

Figure 1B:
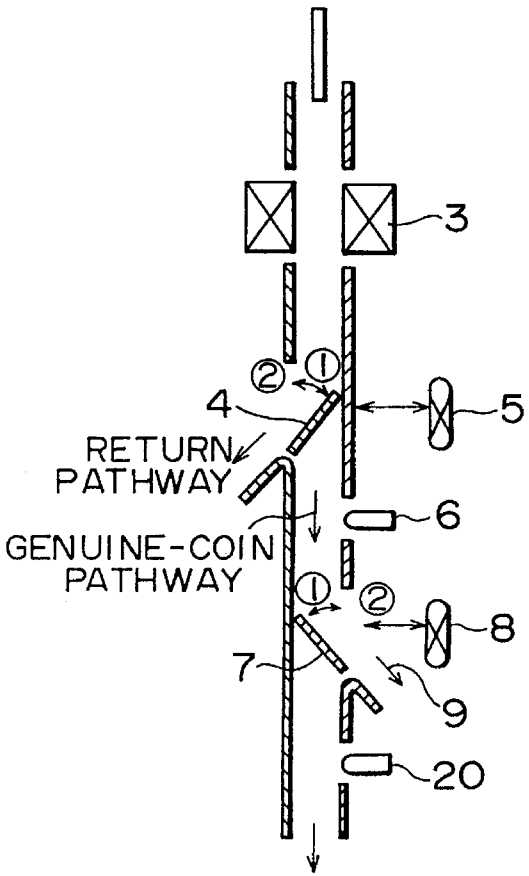
FIG. 1A and FIG. 1B are conceptual diagrams of a front view and a coin pathway of a first embodiment of the present invention.
Figure 1A:
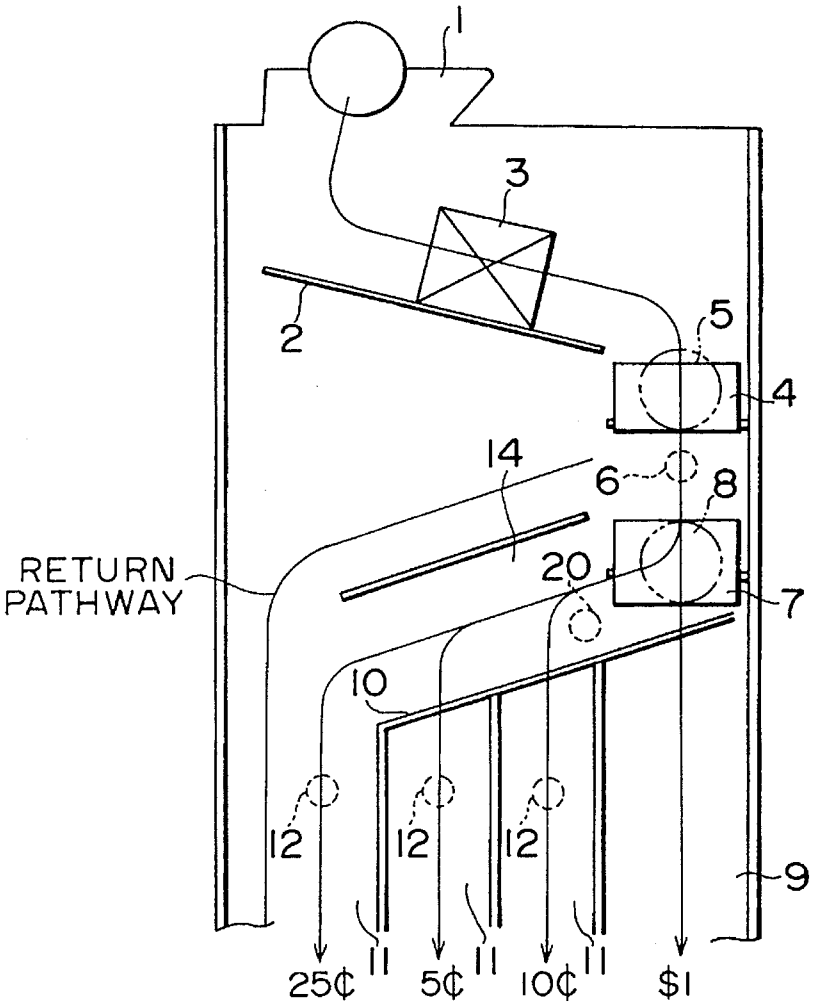
Figure 6B:
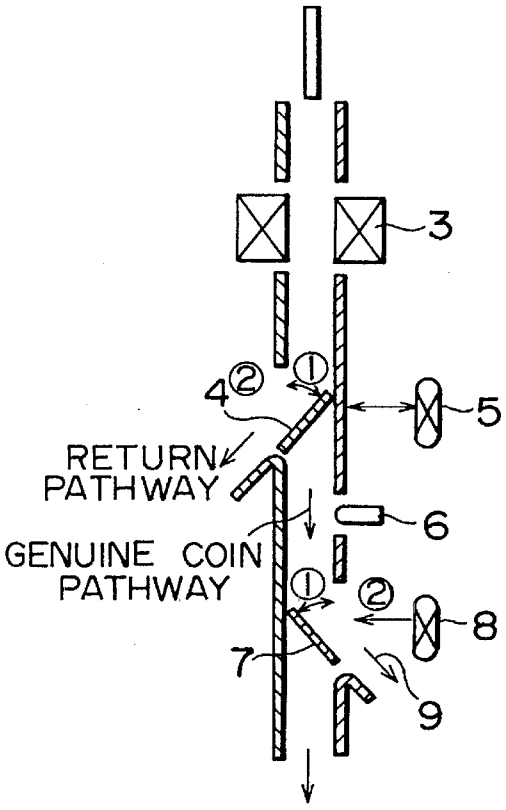
FIG.6B PRIOR ART
FIG. 6A and FIG. 6B diagrams equivalent to those of FIG. 1, showing an apparatus of the prior art.
Figure 6A:
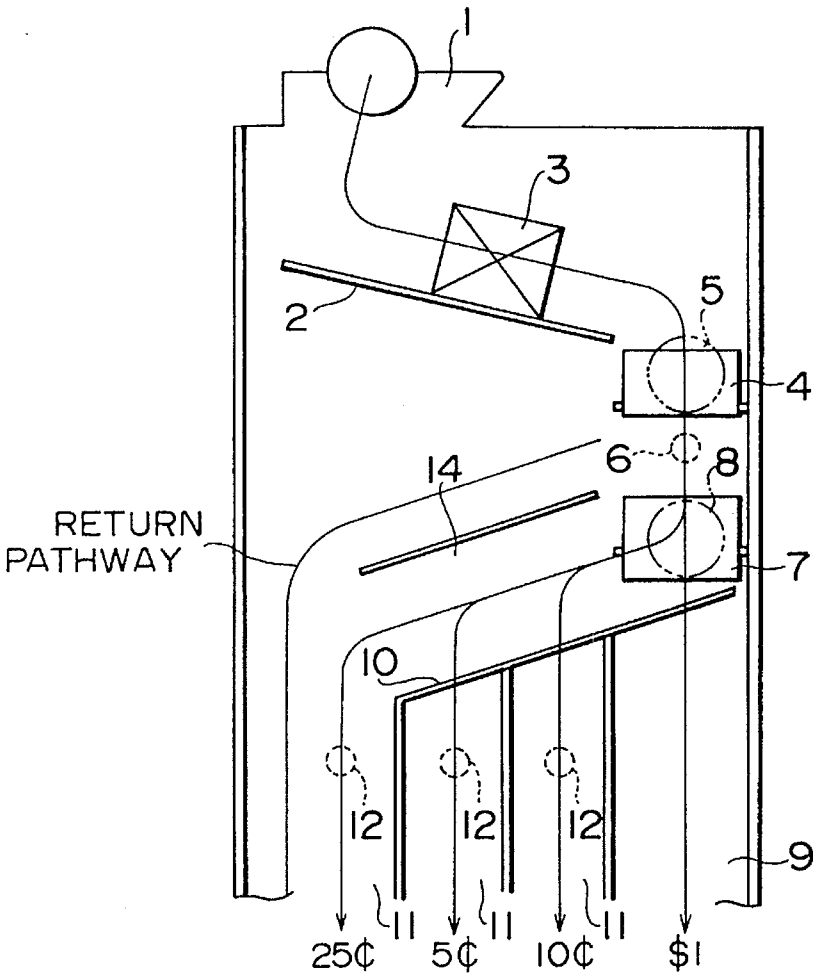
FIG.6A PRIOR ART
Figure 7:
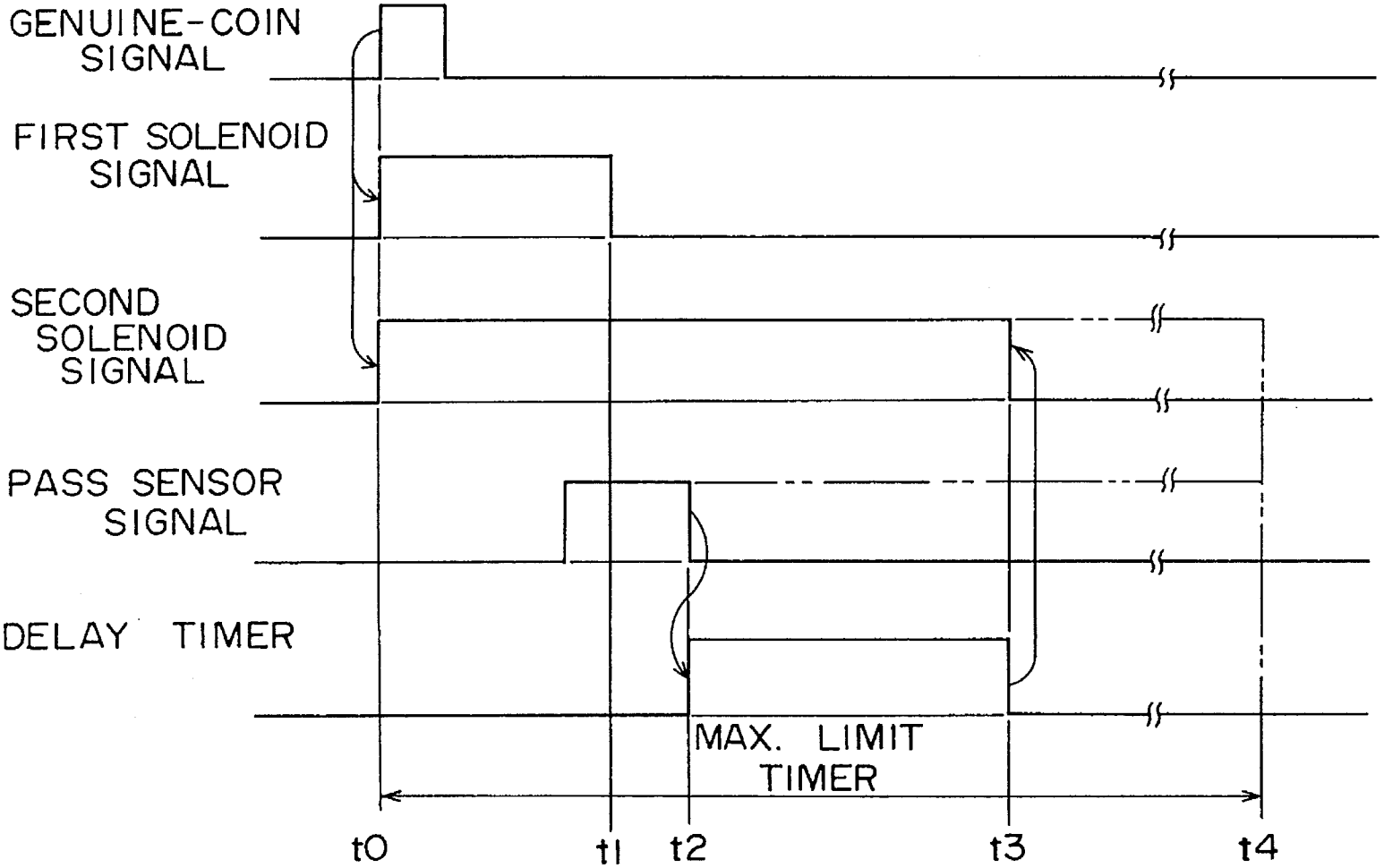
FIG. 7 PRIOR ART
FIG. 7 is a signal waveform chart of the circuit portions of the prior art apparatus of FIG. 6A and FIG. 6B.
Figure 8:
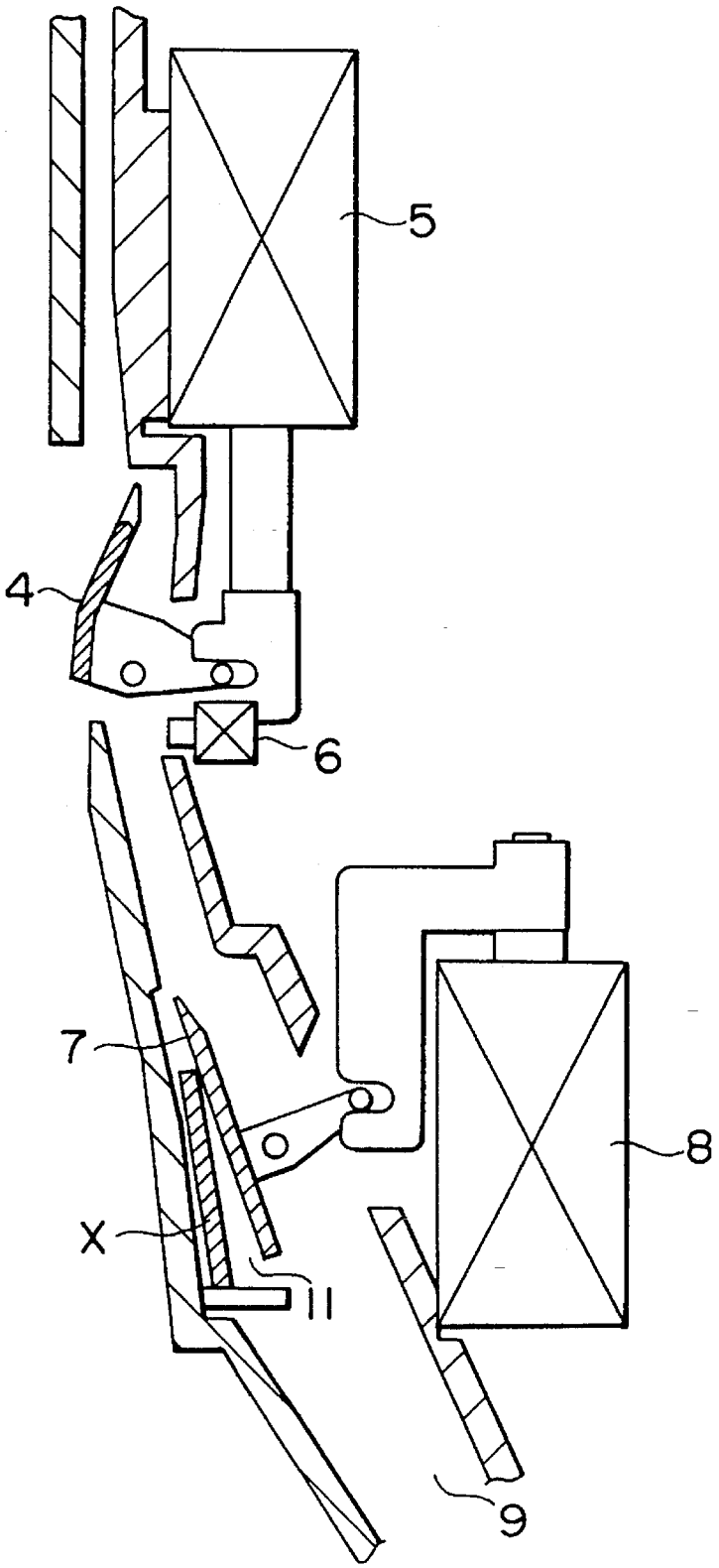
FIG. 8 PRIOR ART
FIG. 8 is an explanatory diagram of the status when a coin becomes jammed in the prior art apparatus of FIG. 6A and FIG. 6B.

The configuration of a coin processing apparatus of a first embodiment of the present invention is shown in FIG. 1A and FIG. 1B. In these figures, the configuration is the same as that shown in FIG. 6A and FIG. 6B, except that a second pass sensor 20 is provided close to the exit on the change tube pathway 14 side of the second gate 7. In this configuration, the second pass sensor 20 detects a coin that leaves the second gate 7, and generates a signal. Note that hereinafter the pass sensor 6 is referred to as the first pass sensor 6, to differentiate it from the second pass sensor 20.

The coin processing apparatus of this embodiment is described below as handling US \$1, 25¢, 10¢and 5¢coins. Therefore, the configuration is such that three change tubes 11 are provided, for 25¢, 10¢, and 5¢ coins, and \$1 coins are stored directly in a cash-box.

Figure 2:
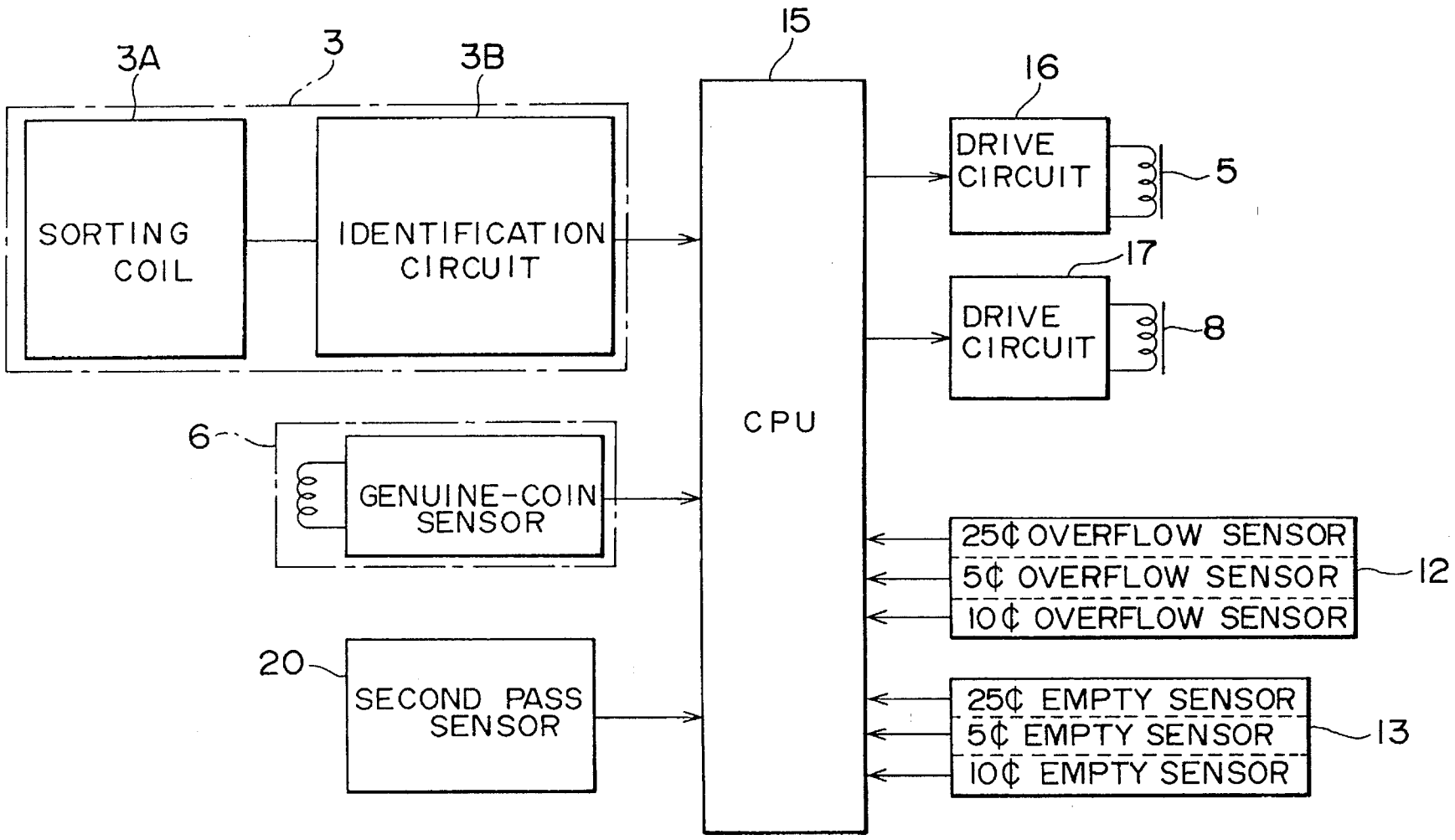
FIG. 2 is a block diagram of the circuit configuration of the embodiment of FIG. 1A and FIG. 1B.

The circuits incorporated in the apparatus of FIG. 1 are configured as shown in FIG. 2. In these circuits, a signal from the coin testing portion 3 (which comprises a sorting coil 3A and an identification circuit 3B), a coin detection signal from the first pass sensor 6, a coin detection signal from the second pass sensor 20, and change excess/insufficiency signals from overflow sensors 12 and empty sensors 13 are received by a CPU 15, the CPU 15 performs a calculation based on those signals, and operations for either coin processing or product sales are performed thereby.

The empty sensors 13 are not shown in FIG. 1, but are provided at the bottom of the change tubes 11. In this case, only the signal circuits that operate the first solenoid 5 and second solenoid 8 are shown; the signal circuits for product sales are not shown.

Although not shown in the figures, the CPU 15 is connected to an inventory switch for paying out change, and preferred types of coins are paid out of the change tubes in answer to the operation of this inventory switch.

Figure 3:
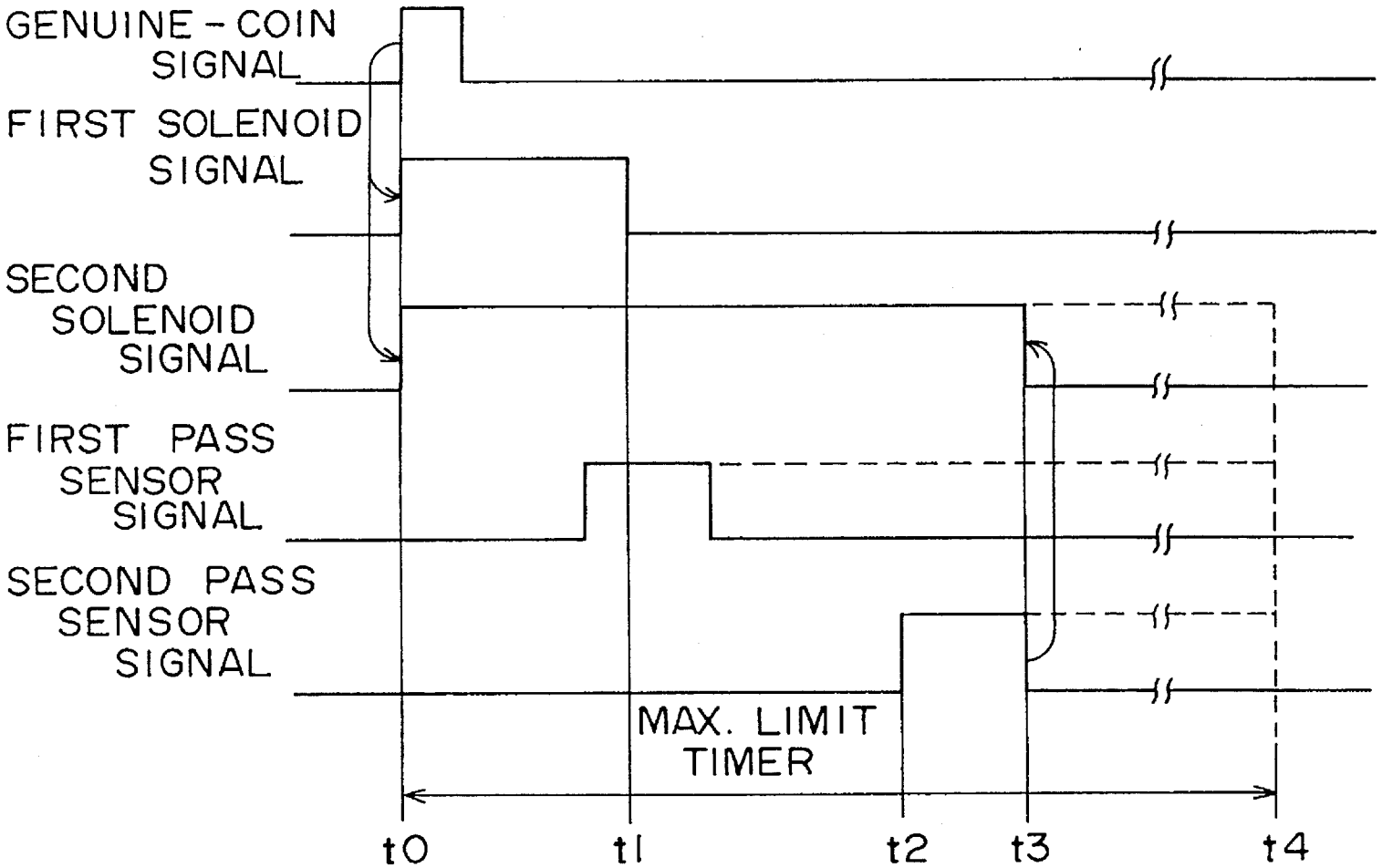
FIG. 3 is a signal waveform chart of the circuits of FIG. 2.

The signals from the various circuits shown in FIG. 2, including the signal from the second pass sensor 20, are shown in FIG. 3. A particular area to note in FIG. 3 is the point that the fall of the second pass sensor signal and the fall of the second solenoid signal are roughly the same from the timing point of view. Strictly speaking, the point at which the second solenoid signal falls is immediately after the second pass sensor signal has fallen.

In other words, after a coin has passed the first gate 4 and been detected by the first pass sensor 6, it proceeds in a direction changed by the second gate 7 toward the change tube pathway 14, and it is detected by the second pass sensor 20 immediately after it leaves the second gate 7. When the output of the second pass sensor 20 falls, the second solenoid 8 is deactivated correspondingly.

Next, the operation of the inserted coin X after it has been inserted through the insertion slot 1 will be described in sequence, with reference to the timing chart of FIG. 3. The description is based on the assumption that no coin reception inhibition signal has been output from the vending machine and none of the overflow sensors of the change tubes has posted a full signal.

First, the inserted coin X is tested by the coin testing portion 3 and, if it is determined thereby to be genuine, a genuine-coin signal is received by the CPU 15 from the coin testing portion 3. The CPU 15 generates a first solenoid signal and a second solenoid signal through a drive circuit 16 and a drive circuit 17, based on this genuine-coin signal, to operate the first solenoid 5 and the second solenoid 8, respectively. This activates the first solenoid 5 for only a short period of time to connect the first gate 4 to the genuine-coin pathway, and activates the second solenoid 8 to connect the second gate 7 to the side of the change tube pathway 14. At this point, the operation of the coin-type decision identifies 25¢, 10¢, and 5¢ coins, and excludes the $1 coins that are to be stored directly in the cash-box. For a $1 coin, once it is determined to be genuine, the first solenoid 5 alone is operated to send the coin directly into the cash-box.

Next, as the inserted coin X approaches the position of the first pass sensor 6, the first pass sensor 6 generates a first pass sensor signal. The CPU 15 learns from receiving the first pass sensor signal that a coin has passed. Since a signal relating to the coin type has already been received from the coin testing portion 3, the CPU 15 can ascertain the monetary amount at that point.

When the inserted coin X then passes the second pass sensor 20, the second pass sensor 20 sends a detection signal to the CPU 15. When this detection signal falls, the CPU 15 cuts the activation current applied to the second solenoid 8, to deactivate the second solenoid 8. At this point, since the inserted coin X is passing the second gate 7, it cannot be trapped by the second gate 7. The genuine-coin pathway below the first gate 4 is connected to the cash-box pathway 9.

If the second pass sensor signal is not generated, even after the predetermined time after the coin testing portion 3 has generated the genuine-coin signal has elapsed, the CPU 15 generates a maximum time limit signal to deactivate the second solenoid 8, using an internal timer that is not shown in the figures. This deactivates the second solenoid 8, even if it has been left temporarily activated, and thus prevents the second solenoid 8 from burning out.

Figure 4:
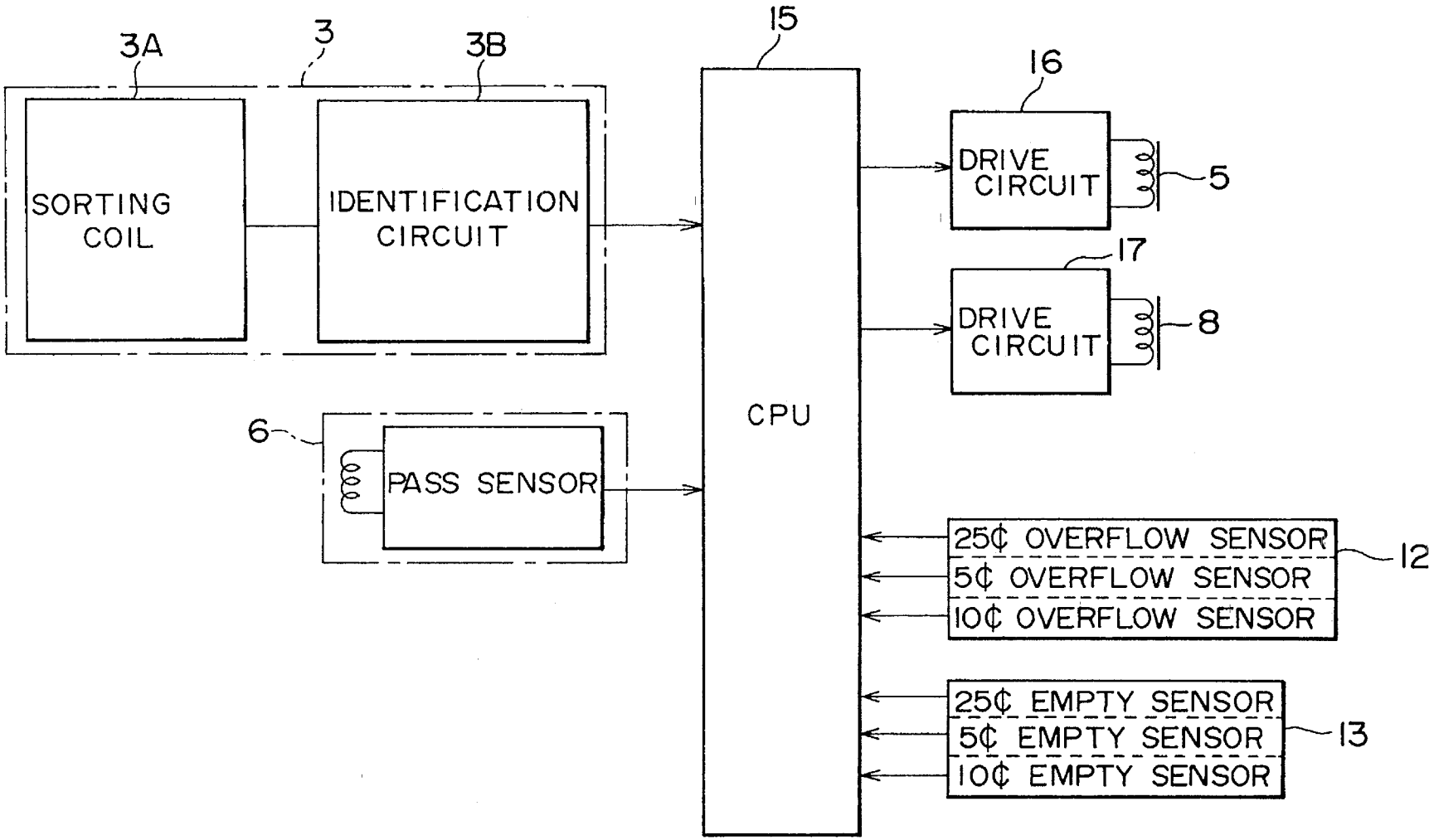
FIG. 4 is a block diagram of the circuit configuration of another embodiment of the present invention.

A block diagram of the circuit configuration of another embodiment of the present invention incorporated into the configuration of FIG. 1 is shown in FIG. 4.

In the circuits shown in FIG. 4, a signal from the coin testing portion 3 (which comprises a sorting coil 3A and an identification circuit 3B), a coin detection signal from a pass sensor 6, and change excess/insufficiency signals from overflow sensors 12 and empty sensors 13 are received by a CPU 15, the CPU 15 performs a calculation based on those signals, and operations for either coin processing or product sales are performed thereby.

The empty sensors 13 are not shown in FIG. 1, but are provided at the bottom of the change tubes 11. In this case, only the signal circuits that operate the first solenoid 5 and second solenoid 8 are shown; the signal circuits for product sales are not shown.

Although not shown in FIG. 4, the CPU 15 is connected to an inventory switch for paying out change, and preferred types of coins are paid out of the change tubes in answer to the operation of this inventory switch.

Figure 5:
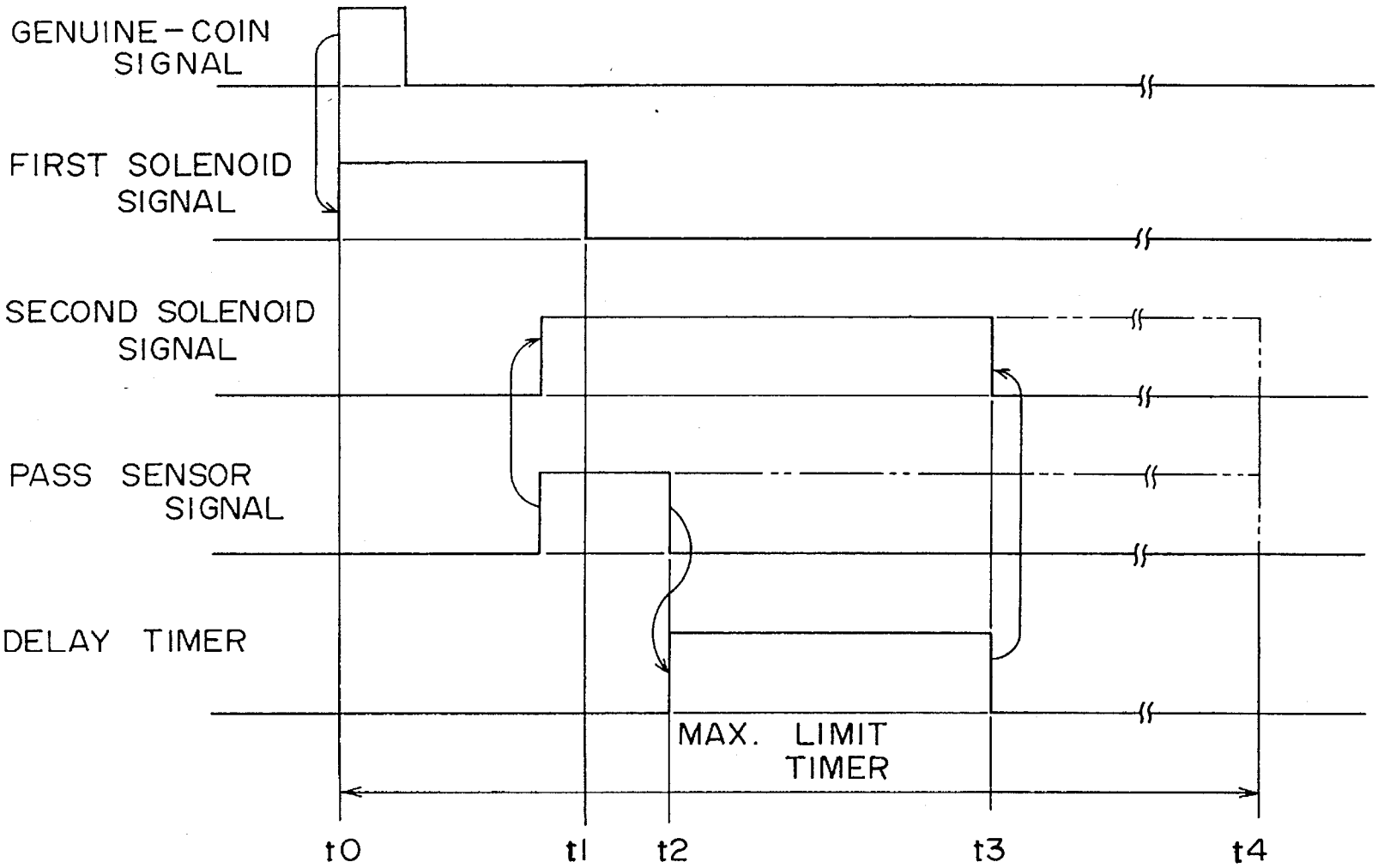
FIG. 5 is a signal waveform chart of the circuits of FIG. 4.

The signals of the various circuits shown in FIG. 4 are shown in the timing chart of FIG. 5. A particular point to note about FIG. 5 is that the second solenoid signal rises with the rise of the pass sensor signal. In other words, the detection by the pass sensor 6 (FIG. 1) of the passing of a coin that has been determined to be genuine starts the activation of the second solenoid and sends the coin into the change tube pathway.

Next, the operation of the inserted coin X after it has been inserted through the insertion slot 1 will be described in sequence, with reference to the timing chart of FIG. 5. The description is based on the assumption that no coin reception inhibition signal has been output from the vending machine and none of the overflow sensors of the change tubes has posted a full signal.

First, the inserted coin X is tested by the coin testing portion 3 and, if it is determined thereby to be genuine, a genuine-coin signal is received by the CPU 15 from the coin testing portion 3. The CPU 15 generates a first solenoid signal for a drive circuit 16, based on this genuine-coin signal, to operate the first solenoid 5. This activates the first solenoid 5 for only a short period of time to connect the first gate 4 to the genuine-coin pathway. At this point, the operation of the coin-type decision identifies 25¢, 10¢, and 5¢ coins, and excludes the $1 coins that are to be stored directly in the cash-box. For a $1 coin, once it is determined to be genuine, the first solenoid 5 alone is operated to send the coin directly into the cash-box.

Next, as the inserted coin X approaches the position of the first pass sensor 6, the pass sensor 6 generates a pass sensor signal. The CPU 15 learns from receiving the pass sensor signal that a coin has passed. Since a signal relating to the coin type has already been received from the coin testing portion 3, the CPU 15 can ascertain the monetary amount at that point.

At the same time, the CPU 15 generates a second solenoid signal for a drive circuit 17, from the pass sensor signal, to start the activation of the second solenoid 8. The passing of the coin erases the pass sensor signal of the pass sensor 6. At this time, a delay timer within the CPU 15 is started by the fall of the pass sensor signal and a signal that waits for a predetermined time is given to the drive circuit 17. Therefore, the drive circuit 17 keeps the second solenoid 8 activated for longer. The second solenoid signal from the drive circuit 17 falls after the predetermined time has elapsed.

As a result, the time during which the second solenoid signal continues turns it into a signal that continues for only a period of time that is the continuation time of the pass sensor signal plus the predetermined time set in the delay timer. Therefore, the second solenoid 8 is not activated for an unnecessarily long time, and thus it does not overheat or burn out.

What is claimed is:

1. In a coin processing apparatus wherein the quality and dimensions of a coin that is inserted through an insertion slot are electromagnetically tested by a testing portion as said inserted coin passes along a predetermined pathway, said inserted coin is sent along either a genuine-coin pathway or a counterfeit-coin pathway by the operation of a first pathway switching mechanism in accordance with the results of said testing and an acceptance enabling/disabling decision, then said coin is sent along either a cash-box pathway or a change tube pathway by the operation of a second pathway switching mechanism in accordance with a coin type obtained from the results of said testing, wherein said change tube pathway is divided into separate tube pathways for each coin type, a coin processing apparatus characterized in being provided with:

a first pass sensor which is provided in said genuine-coin pathway between said first pathway switching mechanism and said second pathway switching mechanism, and which detects the passing of said inserted coin; and a second pass sensor which is provided in said change tube pathway in the vicinity of said second pathway switching mechanism, and which detects the passage of said coin through said change tube pathway to generate a detection signal;

wherein the operation by said second pathway switching mechanism of sending said inserted coin into said change tube pathway is halted until the detection signal falls.

2. A coin processing apparatus in accordance with claim 1, wherein the operation by said second pathway switching mechanism is halted when a control time has elapsed after said coin testing portion has determined that said inserted coin is genuine.

3. In a coin processing apparatus wherein the quality and dimensions of a coin that is inserted through an insertion slot are electromagnetically tested by a testing portion as said inserted coin passes along a predetermined pathway, said inserted coin is sent along either a genuine-coin pathway or a counterfeit-coin pathway by the operation of a solenoid of a first pathway switching mechanism in accordance with the results of said testing and an acceptance enabling/disabling decision, the passing of a genuine coin is detected as said coin passes by a pass sensor provided in said genuine-coin pathway, then said coin is sent along either a cash-box pathway or a change tube pathway by the operation of a solenoid of a second pathway switching mechanism in accordance with a coin type obtained from the results of said testing, wherein said change tube pathway is divided into separate tube pathways for each coin type, a coin processing apparatus characterized in being provided with:

a solenoid activation circuit which starts the activation of said solenoid of said second pathway switching mechanism at the rise of a detection signal from said pass sensor and ends said activation after a predetermined time has elapsed after the fall of said detection signal from said pass sensor.

4. A coin processing apparatus in accordance with claim 3, wherein said predetermined time starts when said detection signal from said pass sensor falls and is determined by a setting of a delay timer that continues an output only during a previously set time.

5. A coin processing apparatus in accordance with claim 3, wherein said coin processing apparatus is provided with a maximum time limit timer that is set to a maximum time that provides the time essential to the operation thereof; and outputs of said pass sensor and an activation circuit attached to said solenoids is halted by an output of said maximum time limit timer.

* * * * *